United States Patent [19]

Dirsking

[11] 4,186,856

[45] Feb. 5, 1980

[54] SELF-PRIMING PASSIVE DOSING DISPENSER

[75] Inventor: Robert S. Dirsking, Cincinnati, Ohio

[73] Assignee: The Procter & Gamble Company, Cincinnati, Ohio

[21] Appl. No.: 933,400

[22] Filed: Aug. 14, 1978

[51] Int. Cl.[2] ..... E03D 9/02

[52] U.S. Cl. ..... 222/424.5; 4/228

[58] Field of Search ..... 222/424.5, 57, 54, 204, 222/416; 4/228, 227, 224

[56] References Cited

U.S. PATENT DOCUMENTS

| | | | |
|---|---|---|---|
| 650,161 | 5/1900 | Williams et al. | 4/228 |
| 1,175,032 | 3/1916 | Williams | 4/228 |
| 3,407,412 | 10/1968 | Spear | 4/228 |
| 3,444,566 | 5/1969 | Spear | 4/228 |
| 3,769,640 | 11/1973 | Castronovo | 4/228 |
| 3,772,715 | 11/1973 | Nigro | 4/228 |
| 3,781,926 | 1/1974 | Levey | 4/228 |
| 3,869,069 | 3/1975 | Levey et al. | 222/180 |
| 3,943,582 | 3/1976 | Daeninckx et al. | 4/227 |
| 3,952,339 | 4/1976 | Baur et al. | 4/228 |

*Primary Examiner*—Stanley H. Tollberg
*Attorney, Agent, or Firm*—E. Kelly Linman; John V. Gorman; Richard C. Witte

[57] ABSTRACT

A self-priming passive dosing dispenser for issuing, beginning with the first flush, a quantity of a toilet tank additive solution into a toilet tank as the water is draining therefrom while the toilet is flushing. A preferred dispenser comprises a reservoir for containing a quantity of a toilet tank additive type product and in which reservoir a solid type product can be dissolved to form a product solution. Structure is provided for flooding the reservoir through the discharge standpipe upon initial immersion of the dispenser into the toilet tank water to ensure first flush dispensing of product solution. In steady state operation, while the water in the toilet tank is receding from about the dispenser, a predetermined dose-volume of toilet tank water is vacuum-transferred from a measuring cavity located within said dispenser into said reservoir through an inlet conduit, and a substantially equal dose-volume of the product solution is dispensed through a discharge standpipe. The dispenser may further comprise an internal baffle to precipitate mixing and agitation inside the dispenser which promote dissolution. Upon reaching steady state operation, the dispenser provides an air-lock when immersed in a full toilet tank which air-lock isolates the product and product solution from toilet tank water which surrounds the dispenser during quiescent periods. Plural product co-dispensers which embody the present invention are also disclosed.

11 Claims, 15 Drawing Figures

SELF-PRIMING PASSIVE DOSING DISPENSER

TECHNICAL FIELD

The present invention pertains, in general, to providing a self-priming dosing type dispenser for such products as toilet tank additives: for instance, cleansers, disinfectants, etc. More specifically, the present invention provides an entirely passive (no moving parts) dispenser in which a solid type product will gradually be dissolved to form a solution, and from which dispenser a quantity of said solution will be incrementally issued each time the water in the toilet tank recedes from around the dispenser, beginning with the first flush of the toilet. Dispenser embodiments of the present invention also provide means for make-up water to enter the dispenser, means for providing agitation by air to mix the make-up water with product solution disposed in the dispenser, and air-lock isolation of the product and product solution from surrounding toilet tank water during quiescent periods once the dispenser reaches steady state operation. Plural product dispenser embodiments are also provided which can, because each provides product and product solution isolation during such quiescent periods, co-dispense solutions of two or more products which should not be mixed before their intended use.

BACKGROUND ART

Passive dosing dispensers of various geometries are disclosed in prior art patents. For instance, U.S. Pat. No. 650,161 which issued to J. Williams et al. on May 22, 1900 and U.S. Pat. No. 1,175,032 which issued to E. R. Williams on Mar. 14, 1916 disclose passive dispensers which are alternately flooded and then syphoned to a predetermined level. Also, U.S. Pat. No. 3,772,715 which issued to L. V. Nigro on Nov. 20, 1973, and U.S. Pat. No. 3,781,926 which issued to J. Levey on Jan. 1, 1974, and U.S. Pat. No. 3,943,582 which issued to J. Daeninckx et al. on Mar. 16, 1976 disclose passive dispensers which are alternately flooded and then gravitationally drained. Moreover, U.S. Pat. No. 3,407,412 which issued to C. T. Spear on Oct. 29, 1968, and U.S. Pat. No. 3,444,566 which issued to C. T. Spear on May 20, 1969 disclose dispensers which, although they have no moving parts, must be connected to a pressurized water supply such as the trap refill tube in a toilet tank and in which the direction of flow alternates in labyrinth passages. However, none of the aforementioned prior art patents disclose a passive dosing dispenser for the purpose described which has solved such problems as providing mixing of make-up water with product solution, and of providing product and product solution isolation from surrounding water during quiescent periods.

A significant advance over such prior art dispensers is disclosed in the co-pending patent application of Robert S. Dirksing, Ser. No. 897,477 filed Apr. 18, 1978 and entitled PASSIVE DOSING DISPENSER, said application being hereby incorporated herein by reference. A number of highly efficient passive dosing dispenser embodiments solving many of the problems inherent in such prior art dispensing apparatus are disclosed in the aforementioned patent application of Robert S. Dirksing. As is pointed out in said application with particular respect to dispenser embodiments of the type generally illustrated in FIGS. 1, 10, 11 and 12, the dispenser is initially made functional by filling the product solution reservoir in the dispenser with toilet tank water. This may be accomplished by immersing the dispenser several times in a body of water or by mounting the dispenser in a toilet tank and flushing the toilet several times. However, automatic dispensing of product solution from the reservoir will not take place until the reservoir has first been filled to a predetermined level. Thus, first flush dispensing of product solution with such dispensers cannot be assured without special care to fill the reservoir of the dispenser when the unit is first inserted into the toilet tank.

Failure to provide first flush dispensing of product solution is generally undesirable for two reasons. First, it may cause the consumer to believe the product to be dispensed is ineffective for its intended purpose, since there is no immediately perceptible result upon the first flush of the toilet after installation of the dispenser. Second, where two or more product solutions are to be simultaneously co-dispensed from dissimilar dispenser embodiments so as to produce a particular reaction with one another in cleansing and disinfecting the toilet bowl, it is highly desirable that co-dispensing of each product solution occur on each flush cycle to avoid confusion as to the desired form the reaction should take throughout the useful life of the co-dispensing unit.

Accordingly, it is an object of the present invention to provide a passive dosing dispenser of the type generally illustrated and described in connection with FIGS. 1, 10, 11 and 12 of the aforementioned patent application of Robert S. Dirksing, which dispenser will provide first flush dispensing of product solution without need for the consumer to exercise special care in filling the reservoir of the dispenser when initially inserting the unit into the toilet tank.

DISCLOSURE OF INVENTION

In accordance with a preferred embodiment of the invention, a self-priming dispenser is provided which comprises an internal reservoir for containing a quantity of a solid product and product solution, and means for causing a predetermined dose-volume of a liquid to be conducted into the reservoir so that a substantially equal volume of the solution is displaced from the reservoir and caused to issue from the dispenser in response to the level of a body of the liquid being lowered from a first elevation to a second elevation. Such a dispenser preferably comprises a dose-volume measuring cavity, a reservoir, an inlet conduit, and a discharge standpipe which are so associated that the inlet conduit interconnects the cavity with the upper reaches of the reservoir, and the standpipe extends downwardly from the upper reaches of the reservoir and has an open lower end. Such a dispenser can further comprise an internal baffle which is so configured and so disposed intermediate the top end of the inlet conduit and the upper end of the discharge standpipe that it induces air-mixing of make-up water with solution disposed in the reservoir, and thereby promotes further dissolution of the solid product disposed in the reservoir. In a particularly preferred embodiment, the measuring cavity of the self priming dispenser is provided with a first inlet port pervious to the passage of liquid and located at a sufficiently high elevation with respect to the upper end of said discharge standpipe that said reservoir is filled by water entering through said discharge standpipe when said dispenser is initially immersed in the water contained in the toilet tank. Because the reservoir is initially filled by toilet tank water entering through the discharge standpipe rather than by toilet tank water vacuum-transferred from the measuring cavity when the dispenser is initially immersed, the dispenser is termed self-priming, i.e., it functions to dispense product solution upon the first flush of the toilet after immersion in the toilet tank water. The measuring cavity is also provided with a second inlet port having means for making said port impervious to the passage of liquid for a period of time sufficient for said reservoir to be filled by water entering through said discharge standpipe upon the initial immersion of said dispenser in the water contained in said toilet tank. Said means for making said second inlet port impervious to the passage of liquid are preferably liquid soluble so as to make said second inlet port pervious to the passage of liquid upon sustained immersion in the toilet tank water. Once said second inlet port becomes pervious to the pasage of liquid, the dispenser reaches what is herein referred to as steady state operation, i.e., a dose-volume of product solution is discharged with each flush cycle of the toilet and the product and product solution are isolated from the water in the discharge standpipe and the inlet conduit during quiescent periods intermediate flush cycles. Said second inlet port is located at a sufficiently low elevation with respect to the upper end of said discharge standpipe that, upon dissolution of said means making said second inlet port impervious to the passage of liquid, the first inlet port serves no further function and the measuring cavity is filled through said second inlet port before the level of the water in said toilet tank reaches the upper end of said discharge standpipe as the toilet tank refills. This provides air-lock isolation between the product and product solution contained in the reservoir and the water contained in the toilet tank during quiescent periods intermediate flush cycles. Thus, upon reaching steady state operation, the dispenser functions in a manner similar to that described in connection with the embodiments of FIGS. 1, 10, 11 and 12 of the aforementioned patent application of Robert S. Dirksing.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

BEST MODE OF CARRYING OUT THE INVENTION

Figure 1:
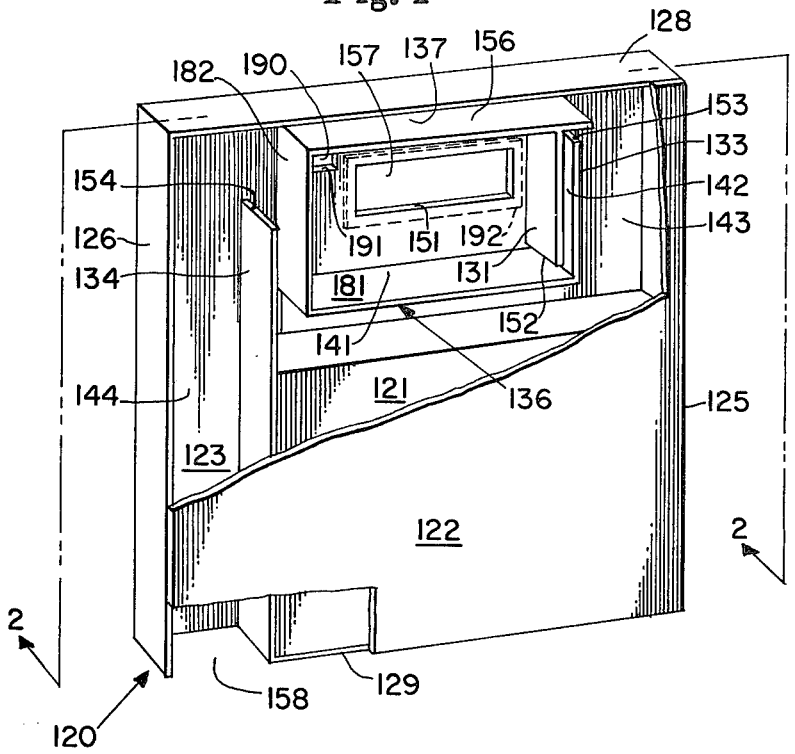
FIG. 1 is a partially torn away perspective view of a passive dosing dispenser which is an embodiment of the present invention.

Referring to the Figures in which identical features are identically designated, FIG. 1 shows a self-priming dispenser 120 embodying the present invention and containing a solid, water soluble product 121. Dispenser 120 comprises a front wall 122, a back wall 123, two side walls 125 and 126, a top wall 128, a bottom wall 129, interior partition 134 and a baffle 136. The baffle 136 is defined by rigid partitions 131, 133, 181, 182 and 156. The walls and partitions of the dispenser 120 are relatively rigid and define a dose-volume measuring cavity 141, an inlet conduit 142, a product solution reservoir 143, and a discharge standpipe 144. The outlet port of dispenser 120 is designated 158. The dispenser 120 is provided with two rectangular-shaped inlet ports 157 and 190. Inlet port 157 is initially made impervious to the passage of liquid therethrough by means of a piece of liquid soluble tape 192 secured to back wall 123 about the periphery of the port, while inlet port 190 remains pervious to the passage of liquid therethrough at all times. The bottom edge of rectangular-shaped inlet port 157 is designated 151, the bottom edge of rectangular-shaped inlet port 190 is designated 191, partition 131 has its bottom edge designated 152, partition 133 has its top edge designated 153, partition 134 has its top edge designated 154, and the vent passage intermediate the top wall 128 of dispenser 120 and the uppermost partition 156 of baffle 136 is designated 137. In a preferred embodiment of dispenser 120, edge 153 is at a greater elevation than edge 154; edge 154 is at a greater elevation than edge 151; edge 191 is at a greater elevation than edge 154; and partition 181 is at a lower elevation than edge 154. Together, cavity 141 and conduit 142 form a trap-type inlet.

Figure 2:
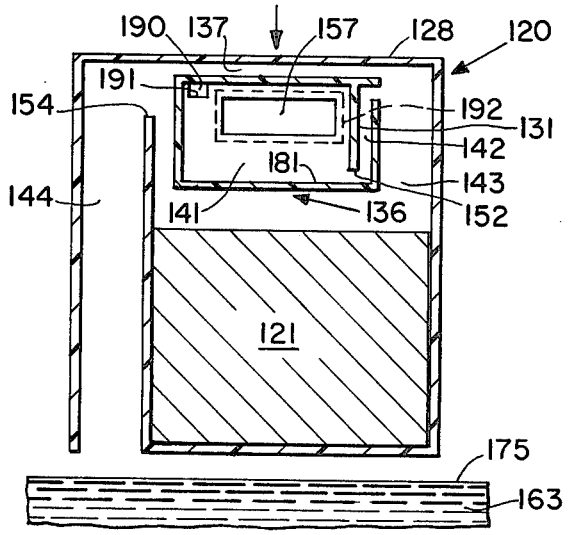
FIGS. 2–12 are reduced scale, simplified sequential sectional views which show a portion of a cycle of the dispenser shown in FIG. 1 and which views are taken along section line 2—2 of FIG. 1.

In FIG. 2 is shown a self-priming dispenser 120 containing solid product 121 about to be immersed for the first time in a toilet tank (not shown) filled with water 163 on a bracket or other mounting means (not shown) to a depth such that the FULL level of water in the toilet tank will completely cover inlet port 190. The dispenser 120 will respond in a manner similar to that shown in FIGS. 3–5 each time the toilet tank is refilled so long as inlet port 157 remains impervious to the passage of liquid therethrough.

Figure 3:
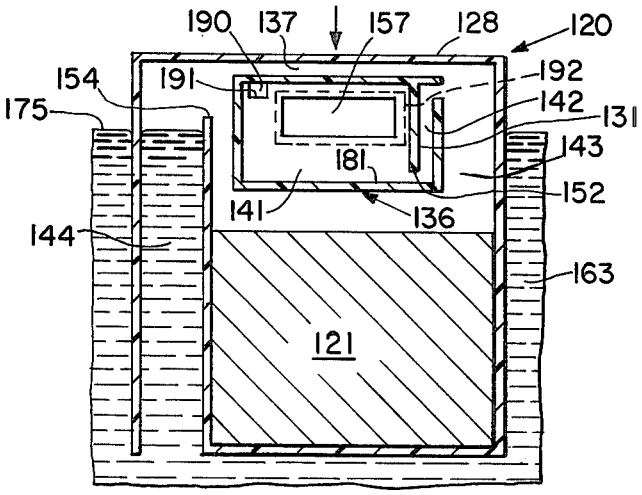

As shown in FIG. 3, when the uncharged dispenser 120 is partially immersed with the liquid soluble, in this case water soluble, tape 192 secured about the periphery of inlet port 157, water rises within the discharge standpipe 144, thereby causing air within the dispenser to vent via passageway 137 and beneath baffle 136, through inlet conduit 142 and dose-volume measuring cavity 141 and ultimately out inlet port 190. Tank water is prevented from entering the dose-volume measuring cavity 141 by means of the water soluble tape 192 which temporarily renders inlet port 157 impervious to the passage of liquid therethrough. Thus, inlet port 190 provides the only air vent so long as tape 192 is present.

Figure 4:
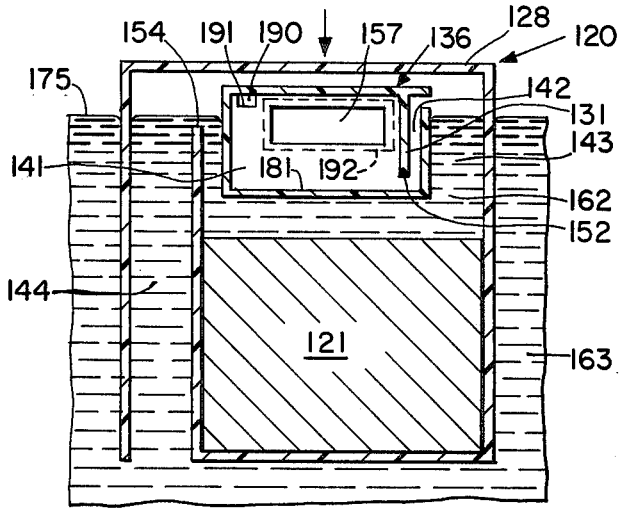

Because edge 191 of inlet port 190 is at a higher elevation than edge 154 which forms the upper end of discharge standpipe 144, toilet tank water eventually overflows edge 154 and enters product solution reservoir 143. This condition is illustrated in FIG. 4. When the liquid level in solution reservoir 143 rises above partition 181, air contained within the dispenser continues to vent via passageway 137, inlet conduit 142, measuring cavity 141 and out inlet port 190 until the interior portion of the dispenser 120 located below the uppermost edge of inlet port 190 is completely flooded by toilet tank water.

If inlet port 190 is immersed before solution reservoir 143 is filled with water, air will continue to vent through inlet port 190 and will bubble into the tank water, provided the port is properly sized. The latter situation requires only that inlet port 190 be large enough that the head pressure of the liquid located within the dispenser between edge 154 of partition 134 and edge 191 of inlet port 190 be sufficient to overcome the surface tension of the water in the toilet tank across inlet port 190. The greater the differential elevation between edge 154 and edge 191, the smaller inlet port 190 may be and still accomplish the desired venting. On the other extreme, inlet port 190 must be sized sufficiently small that air will be allowed to vent as described above, yet toilet tank water will not be permitted to flow back into measuring cavity 141 while reservoir 143 of dispenser 120 is filling. Premature flow of toilet tank water through inlet port 190 while inlet port 157 remains impervious to the passage of liquid could cover edge 152 of partition 131 and preclude complete filling of solution reservoir 143. This would of course have an adverse affect upon first flush dispensing of product solution 162.

In yet another embodiment of the present invention, inlet port 190 could be joined to a snorkel (not shown) projecting above top wall 128 of dispenser 120. Such a snorkel effectively increases the differential elevation between edge 154 of partition 134 and edge 191 of inlet port 190. Accordingly, the head pressure of the liquid located between same would likewise be increased. The snorkel could, if desired, be of sufficient height that it remains above the FULL level of the water contained in the toilet tank when the dispenser has been installed therein, thereby providing constant venting of measuring cavity 141 and obviating the need to observe the sizing criteria discussed in the preceding paragraph.

Figure 5:
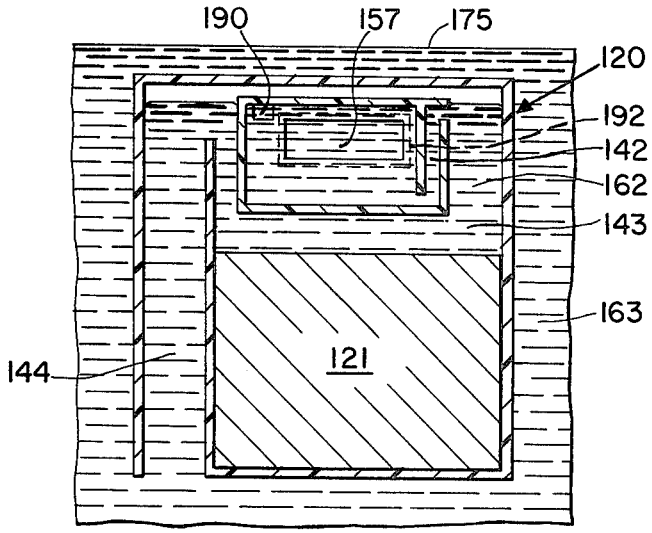

As is shown in FIG. 5, when the dispenser 120 is completely immersed in the toilet tank water, the water in the reservoir 143 in contact with the solid, water soluble product 121 begins to dissolve the solid product to form a product solution 162. It should be noted, however, that because inlet port 157 is impervious to the passage of liquid during the initial immersion of the dispenser 120 into the water, no air-lock isolation is provided between the product solution 162 being formed in the reservoir 143 and the toilet tank water in the discharge standpipe 144 and the inlet conduit 142. Although only a dose-volume of water is vacuum-transferred from the measuring cavity 141 to the solution reservoir 143 on the first flush cycle, the quantity of product solution 162 issued from the dispenser on the first flush cycle will be greater than that dispensed once the dispenser reaches steady state operation, since the reservoir 143 is flooded to an abnormally high elevation through discharge standpipe 144 when the dispenser is initially immersed.

In order to provide first flush dispensing of product solution 162 from the dispenser 120 it is necessary that inlet port 157 remain substantially impervious to the passage of liquid therethrough for a period of time sufficient to permit filling of the reservoir 143 with liquid entering through the discharge standpipe 144. In this regard it should be noted that immersion of the dispenser 120 into the toilet tank water initiates a dissolving action on the water soluble tape 192 blocking inlet port 157. Once the product solution reservoir 143 has been filled with liquid, inlet port 190 has served its purpose, and dissolution of the water soluble tape 192 serves to restore the dispenser to a mode of operation similar to that disclosed in connection with the dispenser embodiments illustrated in FIGS. 1, 10, 11 and 12 of the aforementioned patent application of Robert S. Dirksing, i.e., a dose-volume of product solution 162 is discharged with each flush cycle of the toilet and the solid product 121 and product solution 162 in the reservoir 143 are isolated from the water in the discharge standpipe 144 and inlet conduit 142 by means of an air-lock during quiescent periods once tape 192 has dissolved and the initial flush cycle has been completed. For purposes of clarity this mode is referred to herein as steady state operation.

Figure 6:
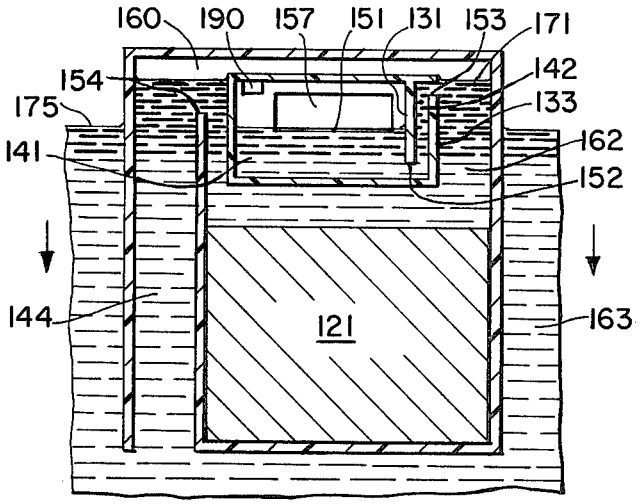
Figure 7:
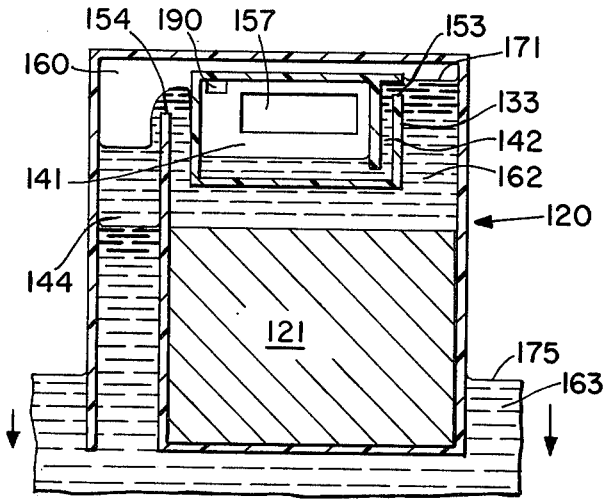

FIG. 6 illustrates the condition prevailing within the dispenser 120 once inlet port 157 has become pervious to the passage of liquid therethrough and the toilet has been flushed, causing the water level in the toilet tank to drop. As is clear from FIG. 6, the water contained within the dose-volume measuring cavity located above edge 151 merely drains back into the toilet tank as the water level falls, leaving the level of the water in measuring cavity 141 substantially even with edge 151 of inlet port 157. Accordingly, inlet port 190 serves no useful function once inlet port 157 has become pervious to the passage of liquid therethrough. As is also clear from FIG. 6, when the level of water 163 coincides with edge 151 of inlet port 157, the top surface 175 thereof is beneath the level of water disposed in the discharge standpipe 144, and product solution reservoir 143, causing a partial vacuum to be developed in the headspace 160. This partial vacuum enables ambient air in the toilet tank to enter through inlet ports 157 and 190 and displace water from the cavity 141 into inlet conduit 142, FIG. 7. This water overflows the top edge 153 of partition 133 and begins to mix with the portion of solution 162 which is disposed adjacent partition 133. The presence of baffle 136 causes the incoming water to be directed downwardly and mix substantially with product solution 162 in the lower reaches of solution reservoir 143. Product solution 162 is displaced from reservoir 143 and flows into discharge standpipe 144.

Figure 8:
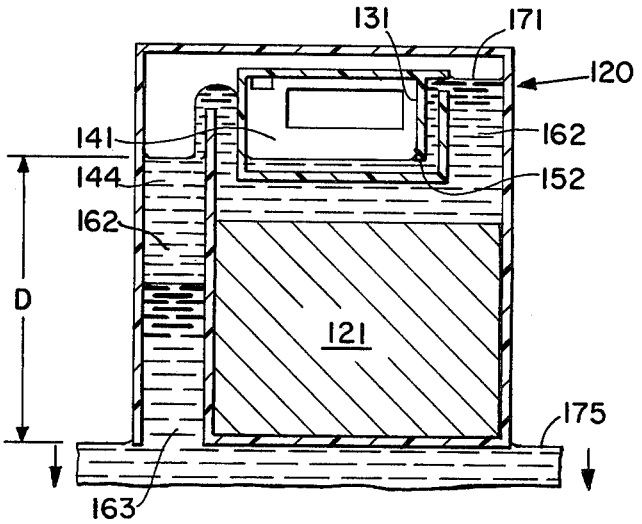

At the time when the level of water in cavity 141 is about to reach the bottom edge 152 of partition 131, FIG. 8, a column of water 163 and product solution 162 is disposed in the discharge standpipe 144 which column extends upwardly a distance "D" from the elevation of the top surface 175 of the receding water 163. It should be noted that the particular distance "D" will be greater for the first flush cycle than for flush cycles which take place after the dispenser has reached steady state operation. This is due to the initial flooding of solution reservoir 143 to an abnormally high elevation.

Figure 9:
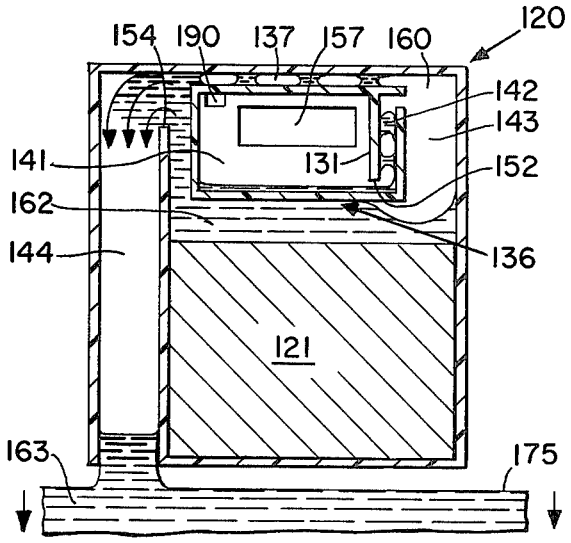

When, as shown in FIG. 9, the level of water in cavity 141 reaches bottom edge 152 of partition 131, passageway 137 is at least partially blocked by liquid attempting to move to the left hand side of the dispenser, and product solution 162 is overflowing edge 154. To at least partially block passageway 137 it is preferable that a portion of the water from measuring cavity 141 be diverted into channel 137. This may readily be accomplished by positioning baffle 136 near side wall 125 so that water flow from inlet conduit 142 into reservoir 143 will back up into passageway 137. Alternatively, the portion of partition 156 extending directly above inlet conduit 142 could be eliminated so that water flow through inlet conduit 142 will be at least partially directed toward the entrance of passageway 137. In either case, the cross-section and length of passageway 137 are preferably so sized that the passageway presents sufficient resistance to the flow of water as to cause the major portion of the water transferred from measuring cavity 141 to be directed downwardly under baffle 136. While any number of means well known in the art may be employed to partially block passageway 137, it is noteworthy that failure to provide the desired blockage will not cause the dispenser to become inoperative. It is merely less preferred than the described embodiment because it does not maximize the mixing action created by the water and air entering solution reservoir 143.

Figure 10:
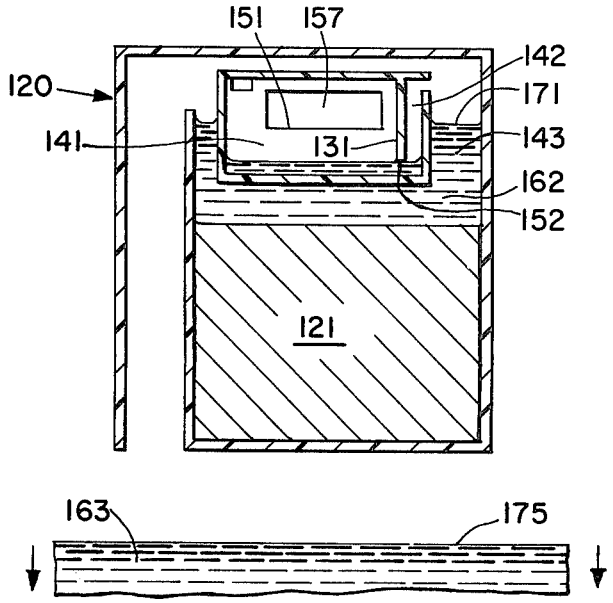

As the water level in measuring cavity 141 reaches bottom edge 152 of partition 131, air enters the reservoir 143 via inlet ports 157 and 190, measuring cavity 141 and inlet conduit 142 and vitiates the vacuum in the headspace 160. This precipitates collapse of the liquid column of height "D" in the discharge standpipe 144, which collapse, in turn, precipitates an inrush of air through inlet conduit 142 into the portion of the headspace 160 disposed to the right (as shown in FIG. 9) of baffle 136. This inrush of air is, in part, diverted downwardly because baffle 136 partially obstructs direct flow across the headspace. Furthermore, the small size of passageway 137 which is preferably partially blocked by water causes the inrushing air to take the path of least resistance, i.e., downwardly into solution reservoir 143, thereby virtually blowing a dose-volume of solution 162 out of the reservoir 143 as indicated by the arrows in FIG. 9. This induces a tempestuous action in the reservoir 143 which results in mixing the water that has just entered the reservoir with the portion of solution 162 then remaining in the reservoir, and causes the solution to be sufficiently agitated to induce further dissolution of solid product 121. FIG. 10 shows the dispenser 120 after the tempestuous action has subsided.

Figure 11:
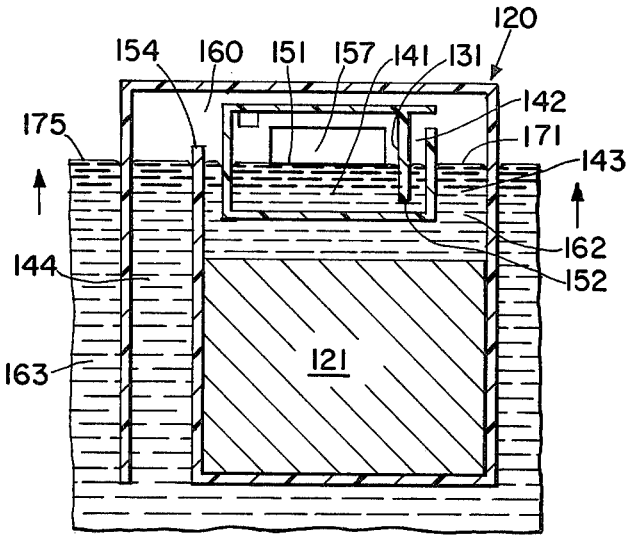

FIG. 11 illustrates the condition of the dispenser 120 as the tank is refilling. Because inlet port 157 is at this point pervious to the passage of liquid therethrough, water floods the cavity 141 through inlet port 157 before the level of water in the standpipe 144 reaches edge 154. This causes air to be trapped in the headspace 160 above the reservoir and standpipe and provides an airlock which isolates the product 121 and the product solution 162 from the water in the inlet conduit 142 and the discharge standpipe 144.

Figure 12:
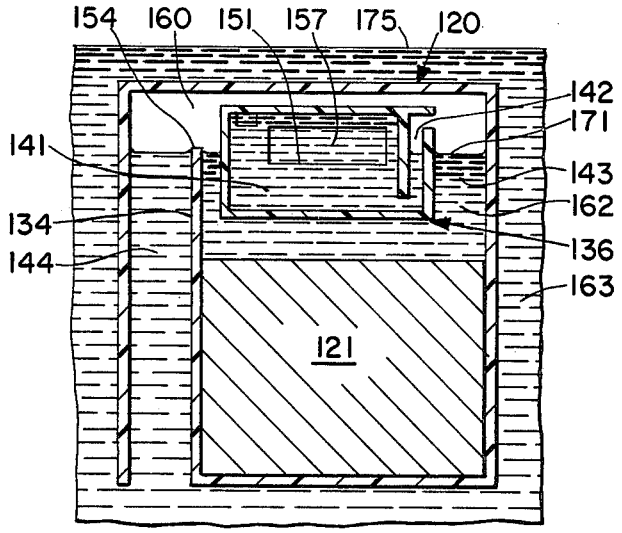

After reaching steady state operation, i.e., inlet port 157 has become pervious to the passage of liquid therethrough, the dispenser 120 will, during quiescent periods while the toilet tank is full of water 163, be in the state shown in FIG. 12. The top surface 171 of solution 162 will be slightly below top edge 154 of partition 134, and have a concave meniscus adjacent edge 154 as shown. Also, toilet tank water 163 will be disposed in cavity 141, the inlet conduit 142, and the discharge standpipe 144. The level of water in conduit 142 will be about the same as in standpipe 144 which level will be below the top edge 154 of partition 134. This is so because edge 151 of entry port 157 is, as stated hereinbefore, at a lower elevation than edge 154.

The dose-volume of dispenser 120 which dose-volume is referred to hereinabove is, essentially, the sum of the partial volumes of both cavity 141 and inlet conduit 142 disposed intermediate the elevation of edge 151 of entry port 157 and edge 152 of partition 131. Note FIG. 11 which shows the dispenser with a dose-volume of water disposed within cavity 141 and conduit 142, and FIG. 10 which shows the dispenser after a dose-volume of water has been transferred into reservoir 143 from cavity 141 and conduit 142 in the manner described herein.

As has been pointed out earlier herein, were baffle 136 not present in the embodiment illustrated in FIG. 1, the dispenser would simply issue a dose-volume of solution 162 as it is displaced by the incoming dose-volume of makeup water from cavity 141. While such a dispenser would, upon reaching steady state operation, provide a high degree of product and product solution isolation from the tank water during quiescent periods, it would not provide the same degree of mixing and agitation in reservoir 143 as compared to dispenser 120 having a baffle 136 or the equivalent thereof. Thus, the baffle 136 comprises means for mixing and agitating liquids disposed in reservoir 143 when a rush of air enters the headspace 160 of the reservoir.

The functional design criteria discussed in detail with respect to sizing the various portions of the dispenser relative to one another and which are generally discussed in relation to the embodiment disclosed in FIG. 1 of the aforementioned patent application of Robert S. Dirksing likewise have general application to a dispenser 120 of the type herein illustrated in FIG. 1. In particular, dispenser 120 is preferably provided with a quantity of a dry, solid type product 121 disposed in it as shown in FIG. 1, and may comprise means (not shown) for being secured in a toilet tank at such an elevation that, when the toilet tank is FULL, cavity 141 will be full of toilet tank water. Furthermore, the discharge standpipe 144 is sufficiently long and of sufficient volume that lowering the level of water surrounding the dispenser will cause a sufficient degree of vacuum in the headspace 160 of the dispenser that a predetermined dose-volume of water disposed in cavity 141 will be vacuum-transferred into the reservoir 143 via inlet conduit 142 before the discharge port 158 is uncovered. While a solid mass of product 121 is shown in the figures, it is not intended to thereby limit the present invention. As will be understood from the description contained herein, dispenser embodiments of the present invention may, after reaching steady state operation, also be utilized to dispense a dose-volume of liquid product solution formed, for example, by dissolving a liquid soluble powder contained within the solution reservoir. In such embodiments, the solid, water soluble product cake is eliminated and the product chamber and solution reservoir house a water soluble powder which dissolves to form a liquid product upon immersion of the dispenser in the toilet tank.

An exemplary embodiment of self-priming dispenser 120 has been fabricated from 1.6 millimeter thick rigid Plexiglas (Registered trademark of Rohm & Haas Company). This exemplary embodiment has a height of about 90 millimeters, a width of about 90 millimeters, and a thickness of about 20 millimeters; its edges 151–154 are spaced from the top wall 128 about 14 millimeters, 23 millimeters, 7 millimeters and 10 millimeters, respectively; edge 191 of inlet port 190 is spaced from the top wall 128 approximately 7 millimeters; partition 181 is spaced approximately 25 millimeters from top wall 128; cavity 141 has a dose-volume of about 8 cubic centimeters; inlet conduit 142 has a cross-section of about 2 millimeters by about 20 millimeters; inlet port 190 has a width of approximately 5 millimeters and a height of approximately 4 millimeters; inlet port 157 has a width of approximately 24 millimeters and a height of approximately 6 millimeters; and discharge standpipe 144 has a cross-section of about 16 millimeters by about 20 millimeters. Also, baffle 136 of the exemplary embodiment illustrated in FIG. 12 is disposed about 3 millimeters from dispenser side wall 125 and measures approximately 52 millimeters in width by 25 millimeters in height. Passageway 137 has a cross-section of about 1 millimeter by about 20 millimeters. As is shown in FIGS. 1-11, the top end of inlet conduit 142 (which top end is defined as edge 153 of partition 133) extends to a greater height in the upper reaches of reservoir 143 than the top end of the discharge standpipe 144 (which top end is defined as edge 154 of partition 134). The strip of water soluble tape 192, secured to back wall 123 about the periphery of inlet port 157, consisted of dissolving paper as available from Gilbreth International Corporation of Cornwells Heights, Pennsylvania coated on the surface contacting back wall 123 with Prim's gift wrapping adhesive as available from Hyco Products of Cincinnati, Ohio. When immersed, the paper dissolves, thereby rendering inlet port 157 pervious to the passage of liquid.

While the exemplary embodiment of the dispenser 120 was constructed by adhesively securing sections of Plexiglas to one another, other relatively rigid materials which are substantially inert with respect to the intended product and aqueous solutions thereof can be used to construct dispenser 120. For example, a dispenser having the desired passageways could be vacuum thermoformed in two sections of a material such as polyvinyl chloride having an initial thickness of about 0.020 inches, the solid product 121 inserted therebetween and the two sections thereafter secured to one another as by heat sealing, adhesives, etc. along a line of contact substantially coinciding with section line 2—2 of FIG. 1.

Furthermore, suitable means other than liquid soluble, i.e., water soluble, tape 192 may be employed to render inlet port 157 temporarily impervious to the passage of liquid therethrough. For example, a strip of any type of non-water soluble, liquid impervious material may be secured in place by means of any suitable liquid soluble, i.e., water soluble, adhesive such as a dextrin adhesive, as available from H. B. Fuller Company of St. Paul, Minnesota. Upon immersion in water, the adhesive dissolves, allowing the liquid impervious strip to fall away and render inlet port 157 pervious to the passage of liquid. Alternatively, a continuous coating comprised of a water soluble film forming agent such as polyvinyl alcohol, as available in 2 mil thick sheets, 88 percent hydrolyzed, from Monosol Division of Chris Craft, Gary, Indiana, may be secured across the surface of inlet port 157 to render it temporarily impervious to the passage of liquid therethrough. In a preferred embodiment, the continuous coating of water soluble film forming agent is procured in sheet form and secured in place by moistening the periphery of inlet port 157 prior to placing the sheet in contact with back wall 123. The moisture causes the sheet to become tacky and adhere to the back wall 123 of the dispenser. Upon sustained immersion in water, the continuous film dissolves, rendering inlet port 157 pervious to the passage of liquid. As will be appreciated by those skilled in the art, the particular material selected to render inlet port 157 temporarily impervious to the passage of liquid may be applied to the interior or the exterior surface of back wall 123, or merely bridged across the opening comprising inlet port 157. Furthermore, strips of water soluble material may be used in combination with water soluble adhesives or water soluble films to accomplish the desired objective. It is only necessary that the particular water soluble material or materials selected to temporarily render the inlet port 157 impervious to the passage of liquid not be adversely affected by either the solid product contained within the dispenser prior to use or by storage conditions likely to be encountered prior to the dispenser's being placed into service, i.e., temperature, humidity, etc.

A dispenser 120 of the type generally illustrated in FIG. 1 permits the use of a symmetrically shaped, solid, water soluble product 121, provides a high degree of surface exposure of the solid product to the product solution 162, and a highly satisfactory flow of incoming toilet tank water 163 across the solid product. However, embodiments of the present invention may with equal facility be incorporated in either single compartment or multiple compartment dispensers of the type generally illustrated in FIGS. 1, 10 and 11 of the aforementioned patent application of Robert S. Dirksing. In such embodiments, the inlet ports 57 and 257, illustrated in FIGS. 1, 10 and 11 respectively of said application, could be covered with water soluble tape, and an additional inlet port provided at an elevation greater than that corresponding to edge 51, i.e., as in the top wall, front wall or back wall portion of the dispenser.

Figure 13:
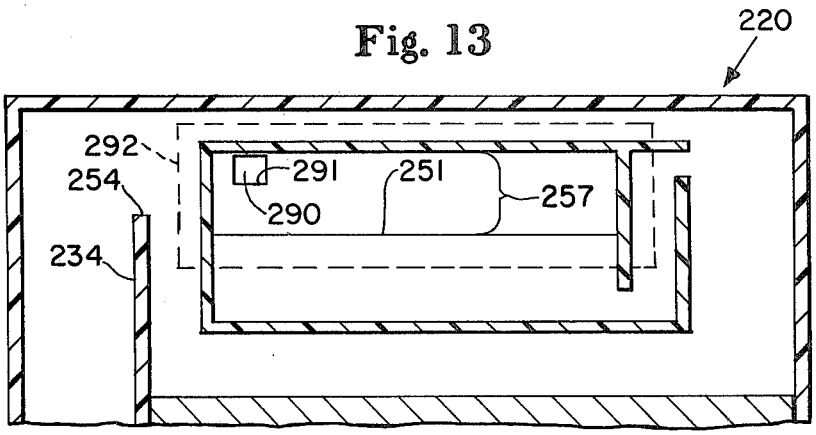
FIG. 13 is a fragmentary sectional view of an alternate embodiment of the present invention.

In FIG. 13 is shown yet another embodiment of the present invention wherein a self-priming dispenser 220 generally similar to that described in connection with FIG. 1 incorporates a second inlet port 257 having a piece of water soluble tape 292 secured entirely about its periphery. Said water soluble tape has a first inlet port 290 pervious to the passage of liquid therethrough, said first inlet port having its lowermost edge 291 at an elevation greater than that of the lowermost edge 251 of said second inlet port and that of edge 254 of partition 234. The dispenser 220 functions in a manner substantially as described in connection with the embodiment of FIG. 1, i.e., product and product solution isolation are not achieved until tape 292 has dissolved and the first flush cycle has been completed.

Figure 14:
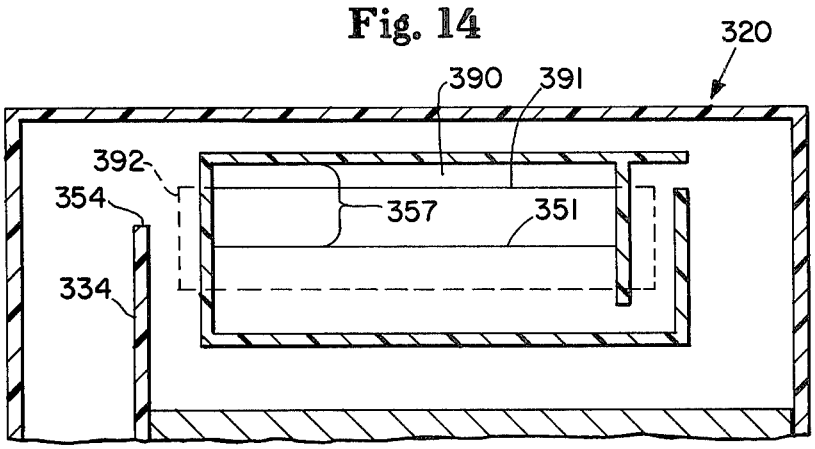
FIG. 14 is a fragmentary sectional view of yet another embodiment of the present invention.

In FIG. 14 is illustrated another self-priming dispenser 320 of the present invention having a second inlet port 357, said second inlet port being made temporarily impervious to the passage of liquid therethrough by means of a piece of water soluble tape 392 secured about the bottom and sides of said second inlet port. A first inlet port 390 is provided within the measuring cavity in the area above the uppermost edge 391 of the water soluble tape 392. Edge 391 which also comprises the lowermost edge of inlet port 390 is at an elevation greater than that of the lowermost edge 351 of inlet port 357 and that of edge 354 of partition 334. Functioning of the dispenser 320 is generally similar to that of the dispensers illustrated in FIGS. 1 and 13.

Figure 15:
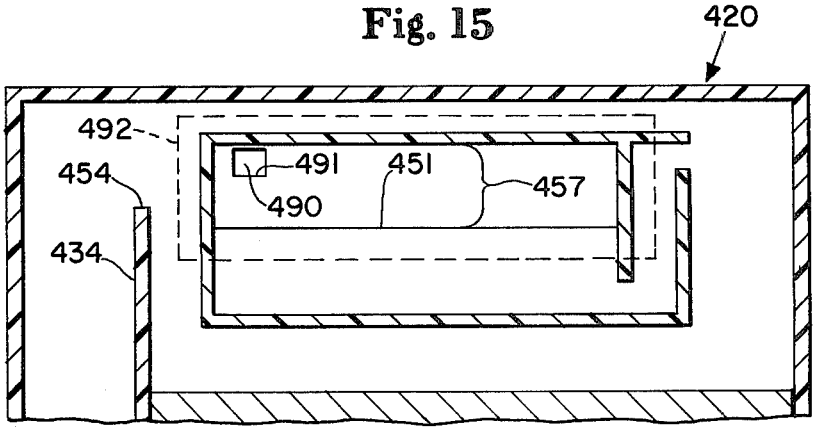
FIG. 15 is a fragmentary sectional view of still another embodiment of the present invention.

In FIG. 15 is shown yet another embodiment of the present invention wherein a self-priming dispenser 420 generally similar to that described in connection with FIG. 1 incorporates a second inlet port 457 having a continuous coating comprised of a film forming agent such as a liquid soluble gelatin 492 or the like secured entirely about its periphery, said continuous coating of liquid soluble gelatin having a first inlet port 490 pervious to the passage of liquid therethrough, said first inlet port having its lowermost edge 491 disposed at an elevation greater than that of the lowermost edge 451 of said second inlet port 457 and that of edge 454 of partition 434. The dispenser 420 functions in a manner substantially as described in connection with the embodiments of FIGS. 1, 13 and 14.

As will be apparent to those skilled in the art, self-priming dispenser embodiments of the present invention may be employed in plural sections to co-dispense plural component products which need to be isolated not only from the toilet tank water during quiescent periods intermediate flush cycles, but also from each other prior to use.

While particular embodiments of the present invention have been illustrated and described, it will be obvious to those skilled in the art that various changes and modifications can be made without departing from the spirit and scope of the invention and it is intended to cover, in the appended claims, all such modifications that are within the scope of this invention. Moreover, while the present invention has been described in the context of dispensing a toilet tank additive, it is not intended to thereby limit the present invention.

What is claimed is:

1. A passive dosing dispenser comprising an internal reservoir for containing a quantity of a solution, and means for causing a predetermined dose-volume of a liquid to be conducted into said reservoir so that a dose-volume of said solution is displaced from said reservoir and caused to issue from said dispenser in response to the level of a body of said liquid being lowered from a first elevation to a second elevation, said means comprising a dose-volume measuring cavity, an inlet conduit, and a discharge standpipe, said inlet conduit having a top end in fluid communication with the interior upper reaches of said reservoir and a bottom end in fluid communication with the bottom portion of said measuring cavity, said standpipe having an upper end in fluid communication with the interior upper reaches of said reservoir and an open lower end, said reservoir being in fluid communication exclusively with said inlet conduit and said standpipe, said reservoir being adapted to hold a quantity of a solid-state product which is solvable in said liquid and for being flooded with said liquid to form said solution in said reservoir by dissolving some of said product, said dispenser further comprising means for being so disposed in said body of liquid that said measuring cavity is filled with said liquid whenever the level of said body of liquid is raised to said first elevation from said second elevation and so that said dose-volume of said liquid will be vacuum-transferred from said measuring cavity via said inlet conduit to said reservoir and said dose-volume of said solution will be displaced from said reservoir into said standpipe and thence from said dispenser whenever the level of said body of liquid is lowered to said second elevation, said measuring cavity including means for making said dispenser self-priming, said means comprising a first inlet port pervious to the passage of liquid located at a sufficiently high elevation with respect to the upper end of said standpipe that said reservoir is filled by liquid entering through said standpipe when said dispenser is initially immersed in said body of liquid, said means also including a second inlet port in said measuring cavity having means for making said second inlet port impervious to the passage of liquid for a period of time sufficient for said reservoir to be filled by liquid entering through said standpipe upon immersion of said dispenser in said body of liquid, said means for making said second inlet port impervious to the passage of liquid being soluble upon sustained immersion in said liquid, said second inlet port being located at a sufficiently low elevation with respect to the upper end of said standpipe that said measuring cavity is filled through said second inlet port before the level of said body of liquid reaches the upper end of said standpipe whenever the level of said body of liquid rises from said second elevation to said first elevation.

2. The dispenser of claim 1, wherein said means for making said second inlet port impervious to the passage of liquid for a period of time sufficient for said reservoir to be filled by liquid entering through said standpipe comprises liquid soluble tape secured about the periphery of said second inlet port.

3. The dispenser of claim 1, wherein said means for making said second inlet port impervious to the passage of liquid for a period of time sufficient for said reservoir to be filled by liquid entering through said standpipe comprises a strip of liquid-impervious material secured about the periphery of said second inlet port by means of a liquid soluble adhesive.

4. The dispenser of claim 1, wherein said means for making said second inlet port impervious to the passage of liquid for a period of time sufficient for said reservoir to be filled by liquid entering through said standpipe comprises a continuous, liquid-impervious coating of liquid soluble film forming agent secured about the periphery of said second inlet port.

5. The dispenser of claim 1, wherein the area occupied by said second inlet port encompasses the area occupied by said first inlet port and said first inlet port comprises a liquid-pervious passageway in said means for making said second inlet port impervious to the passage of liquid for a period of time sufficient for said reservoir to be filled by liquid entering through said standpipe.

6. The dispenser of claim 5, wherein said means for making said second inlet port impervious to the passage of liquid for a period of time sufficient for said reservoir to be filled by liquid entering through said standpipe comprises liquid soluble tape secured about the periphery of said second inlet port.

7. The dispenser of claim 5, wherein said means for making said second inlet port impervious to the passage of liquid for a period of time sufficient for said reservoir to be filled by liquid entering through said standpipe comprises a strip of liquid-impervious material secured about the periphery of said second inlet port by means of a liquid soluble adhesive.

8. The dispenser of claim 5, wherein said means for making said second inlet port impervious to the passage of liquid for a period of time sufficient for said reservoir to be filled by liquid entering through said standpipe comprises a continuous, liquid-impervious coating of liquid soluble film forming agent secured about the periphery of said second inlet port.

9. The dispenser of claim 1, wherein the area occupied by said second inlet port abuts the area occupied by said first inlet port and said means for making said second inlet port impervious to the passage of liquid comprises liquid soluble tape secured in continuous fashion about the lateral edges and bottom of said second inlet port.

10. The dispenser of claim 1, wherein the area occupied by said second inlet port abuts the area occupied by said first inlet port and said means for making said second inlet port impervious to the passage of liquid comprises a strip of liquid-impervious material secured in continuous fashion about the lateral edges and bottom of said second inlet port by means of a liquid soluble adhesive.

11. The dispenser of claim 1, wherein the area occupied by said second inlet port abuts the area occupied by said first inlet port and said means for making said second inlet port impervious to the passage of liquid comprises a continuous, liquid-impervious coating of liquid soluble film forming agent secured in continuous fashion about the lateral edges and bottom of said second inlet port by means of a liquid soluble adhesive.

* * * * *

UNITED STATES PATENT AND TRADEMARK OFFICE

CERTIFICATE OF CORRECTION

PATENT NO. : 4,186,856

DATED : February 5, 1980

INVENTOR(S) : Robert S. Dirksing

It is certified that error appears in the above-identified patent and that said Letters Patent are hereby corrected as shown below:

Title Page, Inventor's name in two places, "Dirsking" should read -- Dirksing --.

Column 3, line 18, "pasage" should read -- passage --.

Signed and Sealed this

*Sixth* Day of *May 1980*

[SEAL]

*Attest:*

SIDNEY A. DIAMOND

*Attesting Officer*

*Commissioner of Patents and Trademarks*